US009383139B2

(12) United States Patent
Pickren et al.

(10) Patent No.: US 9,383,139 B2
(45) Date of Patent: Jul. 5, 2016

(54) SULFUR MELTING SYSTEM AND METHOD

(71) Applicants: Roy Anthony Pickren, Baton Rouge, LA (US); Roger Jacques Maduell, Mandeville, LA (US); David Brian Singleton, New Orleans, LA (US)

(72) Inventors: Roy Anthony Pickren, Baton Rouge, LA (US); Roger Jacques Maduell, Mandeville, LA (US); David Brian Singleton, New Orleans, LA (US)

(73) Assignee: CTI Consulting, LLC, New Orleans, LA (US)

( * ) Notice: Subject to any disclaimer, the term of this patent is extended or adjusted under 35 U.S.C. 154(b) by 395 days.

(21) Appl. No.: 13/987,397

(22) Filed: Jul. 22, 2013

(65) Prior Publication Data

US 2014/0045129 A1 Feb. 13, 2014

Related U.S. Application Data

(60) Provisional application No. 61/742,511, filed on Aug. 13, 2012.

(51) Int. Cl.
*F27D 3/00* (2006.01)
*F27D 27/00* (2010.01)

(52) U.S. Cl.
CPC ..... *F27D 3/0025* (2013.01); *F27D 27/00* (2013.01); *F27D 27/005* (2013.01)

(58) Field of Classification Search
CPC ..... F27D 3/00; F27D 27/00; F27D 27/005; F27D 2003/0054; F27D 3/0025; C01B 17/0221
USPC ..... 23/308 A
See application file for complete search history.

(56) References Cited

U.S. PATENT DOCUMENTS 4,027,656 A * 6/1977 Geddes ..... C01B 17/0221 126/343.5 A
7,918,994 B2 * 4/2011 Lang ..... C01B 17/0232 210/103
2003/0197313 A1 * 10/2003 Areaux ..... F27D 3/08 266/44
2010/0167038 A1 * 7/2010 Linnenbrink ..... B29B 13/022 428/220

* cited by examiner

*Primary Examiner* — Steven B McAllister
*Assistant Examiner* — Ko-Wei Lin
(74) *Attorney, Agent, or Firm* — Raúl V. Fonte

(57) ABSTRACT

A system and a method are provided for melting solid sulfur and maintaining the resulting molten sulfur in liquid state. The system and the method may be fabricated, installed and operated at low capital costs, with high throughput rates at high operating efficiencies and low maintenance costs. Specific embodiments of the invention include modular and non-modular designs, which may be installed and operated with low to high degrees of automation, allowing the user to tailor the final configuration to meet specific requirements. The system of the invention comprises a specific configuration of a prescribed solid sulfur feed unit, a prescribed high-capacity melting unit, a compartmentalized pump tank assembly, and a heat exchanger located outside the high-capacity melting unit. The method provided follows the configuration of the system.

28 Claims, 3 Drawing Sheets

SULFUR MELTING SYSTEM AND METHOD

This application is a non-provisional application for patent entitled to a filing date and claiming the benefit of earlier-filed Provisional Application for Patent No. 61/742,511, filed on Aug. 13, 2012 under 37 CFR 1.53 (c).

FIELD OF THE INVENTION

This invention relates to a system and a method for melting sulfur and, specifically, to an improved system and an improved method for melting solid sulfur and maintaining the resulting molten sulfur in liquid state. More specifically, the invention relates to safe sulfur melting methods and systems that may be fabricated, installed and operated at low capital costs, with high throughput rates at high operating efficiencies and low maintenance costs. Specific embodiments of the invention include modular and non-modular designs; and the invention may be installed and operated with low to high degrees of automation, allowing the user to tailor the final configuration to meet specific requirements.

BACKGROUND OF THE INVENTION

Conventional techniques for melting sulfur often involve mixing crushed, formed or otherwise solid sulfur with liquid sulfur in a tank that has been kept at temperatures above the melting point of sulfur and maintaining the contents of the tank at such temperatures by heating means. Crushed solid sulfur normally originates from solid sulfur lumps and from solid sulfur storage blocks, commonly known as "sulfur vats"; formed solid sulfur usually comes from special industrial operations designed to make specific forms of solid sulfur, such as slate sulfur and sulfur prills, sulfur pellets sulfur pastilles and other such types of granulated sulfur, which are intended for later melting and use as sulfur feed material in various industrial processes. At atmospheric temperatures sulfur is solid; and it remains solid as long as its temperature remains below approximately 240° F.; above this temperature sulfur becomes a fairly fluid liquid; and it remains a relatively low-viscosity fluid until its temperature reaches about 318° F. Above 318° F. sulfur turns very viscous and becomes difficult to pump.

A process for melting sulfur is described in U.S. Pat. No. 3,355,259, of Lipps et al, in which solid sulfur is fed into a tank and mixed with molten sulfur that has been maintained in liquid state at temperatures between 238° F. and 320° F. by the introduction of hot combustion product gases at certain points below the surface of the molten sulfur. This technique has had some commercial applications in the past, but its use is not cost efficient nowadays for various reasons, among them the additional costs required to monitor, process and control the hot combustion product gases in order to maintain the emissions within current environmental discharge requirements. In addition, the combustion product gases introduce contaminants into the liquid sulfur which translate into additional purification costs downstream and/or in the subsequent processing of the molten sulfur product. Certain other known processes for melting sulfur accomplish the melting by providing a melting vessel and introducing steam coils inside the vessel. These processes are able to produce molten sulfur but their overall efficiencies are limited by the limited heat transfer surface area and the size of the vessels that such arrangements entail.

It is an object of the present invention to provide a system and a method for melting sulfur that do not introduce into the molten sulfur any hot combustion gases or any other external sources of heating media, thus avoiding the cost efficiency disadvantages and the contamination problems associated with processes such as the Lipps et al process. It is also an object of this invention to provide a system and a method for the effective melting of crushed or formed solid sulfur that expedite and improve the removal of underflow solids from the tanks where most of the melting takes place and that do not require the introduction of steam coils inside the melting vessels. Another object of the invention is to provide safe sulfur melting methods and systems that may be fabricated, installed and operated at low capital costs, with high throughput rates at high operating efficiencies and low maintenance costs. A further object of the invention is to provide a practical and efficient system and a practical and efficient method for melting solid sulfur that lend themselves to modular fabrication and factory-assembly for easy and cost-effective shipping and on-site assembly. Yet another object of the invention is to provide a system and a method for the effective melting of solid sulfur that allow all of the molten sulfur to be safely contained during unplanned shutdown periods and where all of the vessels and equipment are located above ground, thereby eliminating or minimizing water intrusion, heat losses and other maintenance problems associated with systems and methods that locate vessels or equipment below ground. Still another object of the invention is to provide a system and a method for melting sulfur that allow the flexibility of processing both low and high volumes of solid sulfur feeds without sacrificing either safety or cost effectiveness. An additional object of the invention is to provide a system and a method for the effective melting of solid sulfur that can be industrially fabricated, installed and operated with minimal or no environmental consequences. These and other objects of the invention will become apparent from the descriptions that follow.

SUMMARY OF THE INVENTION

The system and the method for melting sulfur of this invention are described below with reference to their various system components and method steps. In its broadest embodiment the system of the invention comprises a combination of the following specific components: (a) a high-capacity melting unit; (b) means for pumping molten sulfur; and (c) a heat exchanger located outside the high-capacity melting unit and provided with means for heating pumped molten sulfur to a temperature of between about 275° F. and about 350° F. and returning it to the high-capacity melting unit. In one preferred embodiment the system of the invention comprises a specific arrangement of the following components: (a) a solid sulfur feed unit; (b) a high-capacity melting unit; (c) a compartmentalized pump tank assembly; and (d) a shell-and-tube heat exchanger located outside the high-capacity melting unit. In its broadest embodiment the method of the invention comprises a combination of the following specific steps: (a) receiving and melting solid sulfur in a high-capacity melting unit; (b) pumping the molten sulfur to a heat exchanger located outside the high-capacity melting unit; and (c) heating the pumped molten sulfur in said heat exchanger to a temperature of between about 275° F. and about 350° F. and returning it to the high-capacity melting unit. In one preferred embodiment the method of the invention comprises a specific arrangement of the following steps: (a) feeding solid sulfur to a high-capacity melting unit; (b) melting the fed solid sulfur in the high-capacity melting unit; (c) processing the molten sulfur through a compartmentalized pump tank assembly and pumping it to a shell-and-tube heat exchanger located outside the high-capacity melting unit; and (d) heating the processed and pumped molten sulfur in said shell-and-tube heat exchanger to a temperature of between about 275° F. and about 350° F. and returning it to the high-capacity melting unit.

The solid sulfur feed unit of the invention comprises a bulk solid sulfur feed hopper and a solid sulfur feed conveyor (sometimes referred to herein as the "melter feed conveyor"). The hopper is preferably provided with at least one vibrator on its outer surface. The solid sulfur feed unit may also include a lump breaker crusher, depending on the form of sulfur to be melted. The solid sulfur feed conveyor is preferably provided with a cover arrangement in order to prevent contaminants from being deposited on the sulfur feed and to prevent sulfur dust from being emitted from the sulfur handling system. The high-capacity melting unit comprises a vessel made of steel or similar strong material, having a sloped bottom and provided with at least one mixer, or agitator, and at least one overflow pipe conduit. The vessel is sometimes referred to herein as the "melter"; and it is preferably substantially round with a contoured, or molded, sloped bottom, although it may also have a rectangular shape. The melter is also equipped with external steam blisters, spaced around its outer surface, and used to more conveniently control the temperature of the walls or surfaces of the vessel whenever the ambient temperature fluctuates and to maintain the vessel at the desired temperatures during shutdowns. The term "high-capacity", as used herein in conjunction with the melting unit, refers to the fact that such melting unit is capable of melting sulfur at a rate of between about 200 and 5,000 tons per day ("TPD"), or higher. During normal operations in accordance with the method of the invention sulfur flows out continuously through the high-capacity melting unit overflow pipe conduit and into the compartmentalized pump tank assembly, and also simultaneously and continuously along the contoured sloped bottom of the melter, through the transfer pipe conduit(s) and into the compartmentalized pump tank assembly. The compartmentalized pump tank assembly is connected to the high-capacity melting unit and comprises (i) a collection compartment that is equipped to receive and hold molten sulfur from the melting unit, (ii) a pumping compartment located downstream from the collection compartment and equipped with pumps that pump molten sulfur to a shell-and-tube heat exchanger and to a molten sulfur product tank or other molten sulfur destination, (iii) a combination of a weir and a fine-mesh screen, both of which are located between the collection compartment and the pumping compartment, with the fine-mesh screen placed above the weir in such a manner that they cause large-size non-meltables (solids other than sulfur) to settle and be collected in the collection compartment, from where they may be conveniently removed periodically by an operator or by some other means, and (iv) steam blisters or similar means for providing sufficient heat to the compartmentalized pump tank assembly to maintain the temperature of the molten sulfur inside the assembly at approximately 245° F. or higher. At least one pump is provided in the pumping compartment of the compartmentalized pump tank assembly to pump and circulate molten sulfur through the shell-and-tube heat exchanger(s), and at least one pump is provided for pumping molten sulfur out of the system. Under certain circumstances it may be possible to have one pump perform both functions, that is, pump and circulate molten sulfur through the heat exchanger(s) and pump sulfur out of the system. The collection compartment allows the settling of the non-meltables in an area from where they may be conveniently removed periodically, as needed, for example by a mechanical excavator, thereby avoiding the significant delays encountered with conventional melting systems due to having to shut down the system for several days in order to allow time to cool and conduct a "turnaround", i.e., to clean out the melter and pumping equipment, etc.

Sulfur is pumped out of the pumping compartment located downstream from the collection compartment and sent to the prescribed shell-and-tube heat exchanger(s). The prescribed shell-and-tube heat exchanger(s) is (at least one) shell-and-tube heat exchanger designed so that some of the molten sulfur that accumulates in the compartmentalized pump tank assembly may be pumped into and flow inside the heat exchanger tubes while steam is made to flow inside the heat exchanger shell and allowed to condense on the outside of the tubes. Depending on the characteristics of the particular sulfur to be melted, other embodiments of the invention may also make use of different types of heat exchangers, such as plate-and-frame heat exchangers and others. In the shell-and-tube heat exchanger, or exchangers, enough steam is provided to heat the pumped molten sulfur in the heat exchanger tubes to a temperature of between about 275° F. and about 350° F. The heated molten sulfur is then made to exit the tubes of the shell-and-tube heat exchanger and flow into the high-capacity melting unit, where it releases the bulk of the heat (added in the shell-and-tube heat exchangers) to melt the incoming solid sulfur and maintain it in molten state. This feature of the melting system and method of the invention means that virtually all of the system's heating means required to melt the sulfur and maintain its temperature at between about 250° F. and about 300° F. are located outside the melting unit, and not inside the melting unit as is the case in most conventional sulfur melting systems and methods; in other words, the bulk of the heat transfer required by the unit operation takes place outside the melter and melting unit. A competitive advantage of the invention is that the system may be shop-fabricated as a plurality of modules, for example as a package of a bulk solid sulfur feed hopper module, a high-capacity melting unit module, a compartmentalized pump tank assembly module and a heat exchanger module, plus a conveyor assembly module.

In one preferred embodiment of the invention a constantly flowing underflow arrangement is installed on the bottom of the melter's contoured, cone shaped bottom. This underflow arrangement provides continuous removal of non-meltable solids from the bottom of the melter and prevents their build up in the vessel, thereby greatly reducing the potential for significant delays encountered with conventional melting systems due to having to shut down the system for several days in order to allow time to cool and remove the built up solids from the bottom of the melting tank. By providing this underflow, the propensity for abrasion and other damage to the melter from constant movement of these particles is greatly reduced. A grating screen may also be installed as part of the arrangement to prevent very large particles from entering and plugging the underflow.

In another embodiment of the invention a large, non-meltable trash collection sump is added to the bottom of the melter. The collection sump provides a location outside of the melter's vigorous agitation section where large non-meltables may collect. By providing this sump, the propensity for abrasion and other damage to the melter from constant movement of these larger particles is greatly reduced. A cleanout "man way" or "hand way" is normally provided to allow easy removal of these solids. A grating screen may also be installed in the sump when an underflow is provided as discussed above.

In an alternative embodiment of the invention the system and the method disclosed herein are applied to and used in conjunction with a conventional sulfur melting unit of the type that incorporates and employs internal steam coils, or other heating means, located inside said conventional sulfur melting unit, to supplement and improve the efficiency of the sulfur melting operation. This may be done as a new design that combines the external heating concept of the present invention with the internal heating concept of conventional sulfur melting units; or it may be done by incorporating the external heating concept of the present invention to an already existing system that uses conventional internal steam coils, or other heating means, located inside the existing sulfur melting unit.

DETAILED DESCRIPTION OF THE INVENTION

By way of illustration, the sulfur melting system and the sulfur melting method of the invention will be described below with reference to one specific embodiment of the invention, specifically with reference to portions of a system that the owners of the invention have designed for a specific sulfur melting operation. It will be understood that a number of different embodiments are possible which may be adapted to suit the application of the invention to the particular circumstances of other sulfur melting operations.

The specific system design of this particular embodiment is referred to herein as the "High-Capacity Sulfur Melter" or, simply, the "HiCap Sulfur Melter". The HiCap Sulfur Melter is believed to incorporate the best melting technology in the industry, offering the lowest capital costs, the lowest operating costs and the highest operating efficiencies. In addition, it provides the lowest cost-per-ton of molten sulfur produced while operating within one of the safest methods of remelting sulfur. (Since sulfur is often melted, allowed to solidify and then melted again in many industrial operations, it is not uncommon in industry to use the term "remelting" and "remelted" interchangeably with "melting" and "melted". No difference with respect to the physical process or unit operation of melting sulfur is intended herein between "melting" and "remelting", or between "melted" and "remelted".) The modular design of the HiCap Melters also lends itself to easy relocation and lower installation cost than melters used by other technologies.

The specific HiCap Sulfur Melter system design of this particular embodiment has a rated capacity of 100 tons of sulfur per hour ("TPH"), i.e., 2,400 liquid tons of sulfur per day ("TPD"), and offers the following features and competitive advantages: (a) higher capacity allows much greater flexibility and lower cost for operations; (b) melting can be accomplished with reduced manning (reduced hours); and (c) melting rates may be increased or decreased as market conditions dictate and still accomplish the goal of timely melting the desired sulfur quantities. The specific HiCap Sulfur Melter system incorporates key design functionality, allowing lower maintenance costs, downtime and a high degree of automation. In addition, the modular design allows for easy relocation of the unit from block to block and minimizes installation manpower, cost and risk.

Figure 1:
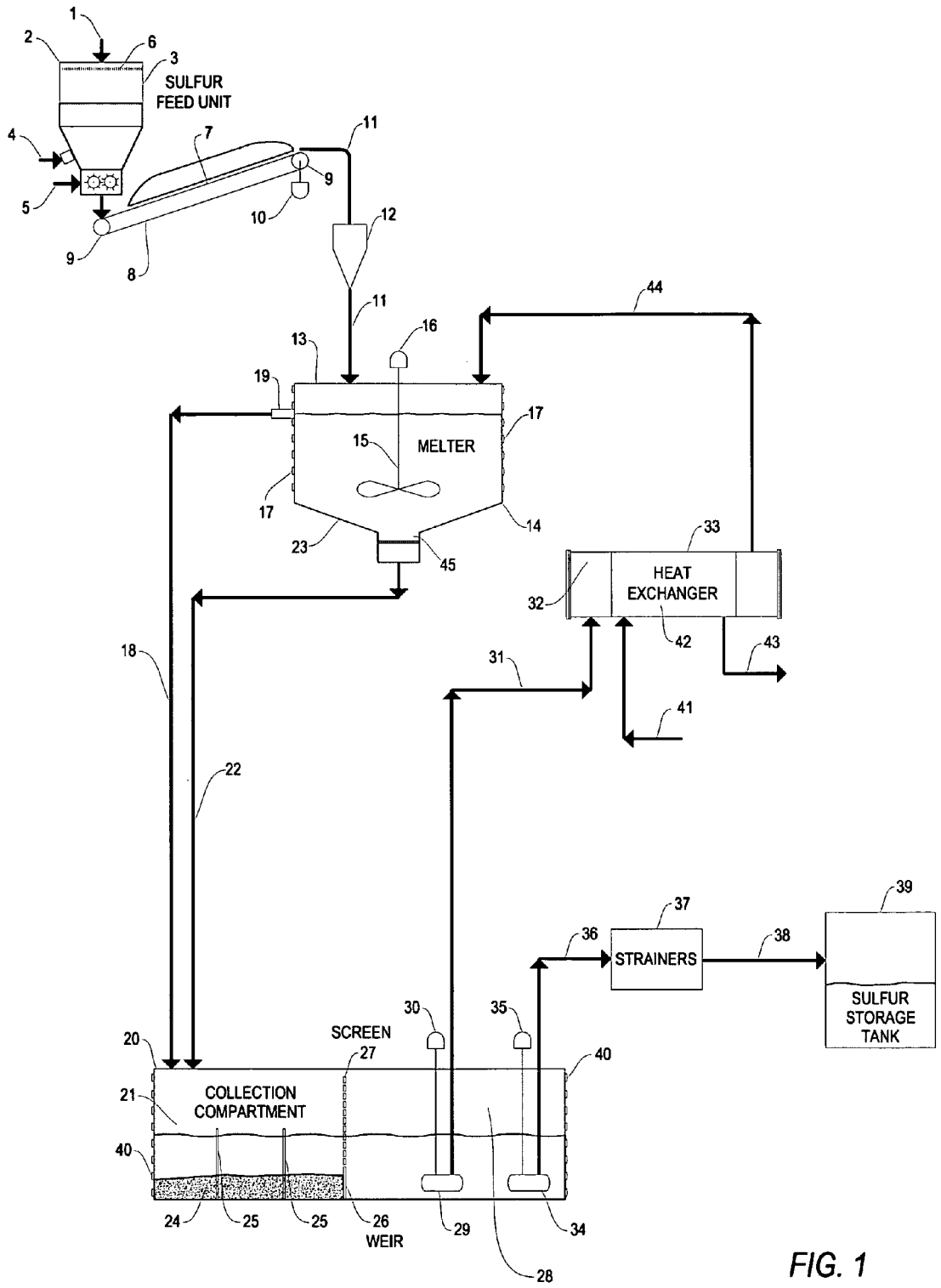
FIG. 1 is a schematic diagram depicting the key components of the system of the invention arranged in the manner specified by one of the preferred embodiments of the system of the invention.

The HiCap Sulfur Melter system comprises a combination of the following components: (a) a solid sulfur feed unit; (b) a high-capacity melting unit; (c) a compartmentalized pump tank assembly; and (d) a shell-and-tube heat exchanger located outside the high-capacity melting unit. These components are shown and identified on FIG. 1. Referring to FIG. 1, bulk solid sulfur 1 is fed at ambient temperature to solid sulfur feed unit 2 through bulk solid sulfur feed hopper 3 at a rate of approximately 100 TPH. Bulk solid sulfur feed hopper 3 is equipped with vibrator 4, attached to its outer surface, and with lump breaker crusher 5, attached to and below its cone shaped bottom. A grizzly 6 sits on top of hopper 3 and allows −10" bulk sulfur to pass through and into vibrating hopper 3 and lump breaker crusher 5, where its size is reduced to −2". As used herein the designations −10" and −2" refer to those solid sulfur particles that have an average size of less than about 10 inches in diameter and less than about 2 inches in diameter, respectively. The −2" bulk sulfur exits lump breaker crusher 5 and moves on to melter feed conveyor 7, operably connected to the discharge end of lump breaker crusher 5. Melter feed conveyor 7 is a variable speed belt conveyor comprising conveyor belt 8, which is operated by rollers 9, driven by conveyor motor 10. It is convenient to maintain a stockpile of crushed vat sulfur or crushed lumps of sulfur nearby the solid sulfur feed hopper when melting. A front-end loader can be used to charge solid sulfur feed hopper 3 from the solid sulfur stockpile.

The −2" bulk sulfur 11 from melter feed conveyor 7 is fed to high-capacity melting unit 13 through conveyor discharge chute 12. The rate of the feed (from hopper to melter) of −2" bulk sulfur 11 into to high-capacity melting unit 13 is controlled by controlling the speed of conveyor belt 8. The rate is normally determined by the heat that is available in the melter to melt the sulfur. Melter feed conveyor 7 is provided with appropriate instrumentation to help ensure its safe operation.

Bulk solid sulfur 11 from conveyor discharge chute 12 enters the high-capacity melting unit vessel (also referred to as the "melter") 14 and encounters hot liquid sulfur 44, which is continuously fed to melter 14 from shell-and-tube heat exchangers 33 (as explained below) thereby forming a mixture of the two sulfurs (ambient-temperature bulk solid sulfur 11 and hot liquid sulfur 44). Melter 14 has an inner surface, an outer surface and a sloped bottom. The melter is preferably round or substantially round, with a contoured cone-shape bottom, and is preferably made of steel; however, it may have a rectangular shape or other shapes, and it may also be made of metal, such as stainless steel or aluminum, as well as of other strong material properly selected for operating at the previously stated temperatures. Melter 14 is equipped with at least one mixer, or agitator, 15, driven by agitator motor 16. Melter agitator 15 may create a vortex that immediately pulls the −2" bulk solid sulfur 11 beneath the surface of the liquid sulfur, wetting all solid surfaces and thereby expediting the melting process. Simultaneously, the vigorous agitation immediately incorporates into the mixture hot liquid sulfur 44 (which is continuously fed to melter 14 from shell-and-tube heat exchangers 33), thereby providing rapid melting. One agitator with a single blade will suffice in many cases, but it is also feasible to use one agitator with multiple blades, as well as multiple agitators with single or with multiple blades. The temperature in melter 14, i.e., the temperature of the inner surface and the outer surface of melter 14, is maintained at approximately 245° F. or higher (and preferably between about 250° F. and 260° F., or higher) by the addition of liquid sulfur 44 heated in steam heated shell-and-tube heat exchanger(s) 33 to approximately between about 275° F. and 350° F. (and preferably between about 280° F. and 290° F.). The rate at which bulk sulfur 11 should be added to melter 14 is determined by the heat available for melting sulfur in melter 14. The speed of conveyor belt 8 may be controlled by monitoring the temperature of the sulfur in melter 14 and maintaining the conveyor belt speed such that the temperature of the sulfur in melter 14 is kept at a constant pre-established level. In the HiCap Sulfur Melter system depicted in FIG. 1 bulk sulfur 11 enters melter 14 at a rate of approximately 200 TPH; while hot liquid sulfur 44 from shell-and-tube heat exchanger 33 enters melter 14 at a rate of between about 400 and 800 TPH.

Steam blisters 17 are provided on the outer surface of melter 14 to keep the outside surface and the inside surface of the melter hot enough (above approximately 245° F.) in order to conveniently prevent the sulfur in and around the melter from solidifying and clogging the vessels, pumps, conduits and other equipment during scheduled and unscheduled shutdowns (e.g., for cleaning, repairs, and/or regular maintenance) or for any other reason, including periodic fluctuations of the ambient temperature. The steam blisters do not contribute any significant amount of heat to the actual melting of the sulfur inside the melter, since all (or virtually all) of the heat used for melting the sulfur in the melter is provided by the molten liquid sulfur 44 that is generated in the shell-and-tube heat exchangers (as mentioned above and explained below). The steam blisters are preferably circular or semi-circular conduits equipped to receive 50 psig-steam from a steam source (not shown) and release condensate after giving off the required amount of heat. The blisters are preferably placed around and surrounding the melter vessel as shown on FIG. 1 and FIG. 2. They also may have rectangular conduit shapes and may be placed around the melter in different configurations. In addition to or instead of the steam blisters other means may be used for providing sufficient heat to the melter to keep its outside surface and its inside surface above approximately 245° F. during scheduled and unscheduled shutdowns. Such other means include steam heating tracing, electrical heating tracing and heating devices that use hot oil or pressurized hot water, as well as other such heating means as may be available and practicable.

Melter overflow molten sulfur 18 overflows and exits melter 14 by way of overflow pipe conduit 19 at approximately 255° F. and is directed to compartmentalized pump tank assembly 20, where it first enters into collection compartment 21. Likewise, limited rates of melter underflow molten sulfur 22 underflow and exit conical melter bottom 23 and are also directed to collection compartment 21 of compartmentalized pump tank assembly 20. By directing underflow molten sulfur 22 into collection compartment 21 in this fashion the melting system is able to collect and eventually remove non-meltables 24 and prevent them from settling in the bottom of the melter. Non-meltable solids that are too large to pass through the underflow piping with underflow molten sulfur 22 are collected in trash sump 45. These features, that is, the trash sump and directing underflow molten sulfur 22 into collection compartment 21, extend the time between melter clean-outs, thereby improving the operability and the efficiency of the melting system and the melting method. Non-meltables include pebbles, rocks, nuts, bolts, bottles, pieces of wood, debris, plastic bags, plastic containers and the like, which tend to inadvertently enter the solid sulfur storage stockpile from time to time. In the HiCap Sulfur Melter system depicted in FIG. 1 melter overflow molten sulfur 18 enters collection compartment 21 at a rate of between about 500 and 1,000 TPH; while melter underflow molten sulfur 22 enters collection compartment 21 at a rate of between about 30 and 60 TPH.

Compartmentalized pump tank assembly 20 comprises a single tank that is divided into at least two compartments. The first compartment (collection compartment 21) is equipped to receive and hold molten sulfur from high-capacity melting unit 13, and it is preferably subdivided into multiple subsections by means of one or more internal baffles 25. The baffles provide a circuitous route for the molten sulfur flowing within compartmentalized pump tank assembly 20, and thereby prevent or minimize short circuiting of the circulating molten sulfur to ensure adequate retention time in compartmentalized pump tank assembly 20. Collection compartment 21 is also equipped with weir 26 and fine-mesh screen 27, so structured and located that large-size non-meltables may be collected and caused to settle in collection compartment 21, from where they may be conveniently removed periodically, as needed, by a mechanical excavator, or by some other practicable means, thereby avoiding having to shut down the system for several days in order to allow time to cool and conduct a "turnaround" (clean up the melter and pumping equipment, etc.). Weir 26 is made of steel, and typically would extend approximately 12 inches above the floor of compartmentalized pump tank assembly 20, extending the entire width of the assembly, and welded or otherwise connected to both (opposite) sides of the assembly. Weir 26 may also be made of aluminum, stainless steel, plastic, synthetic or other strong material. Fine-mesh screen 27 is located contiguous with and above weir 26, extending from the top of the weir to approximately 12 inches above the normal operating level of the molten sulfur in compartmentalized pump tank assembly 20, and also extending the entire width of the assembly. Fine-mesh screen 27 is made of steel and has ¼ inch mesh openings. The screen may also be made of aluminum, stainless steel, plastic, synthetic or other strong material, and its mesh openings are typically anywhere between about 1/16 and ½ inch. For convenience in the maintenance and up-keep of the sulfur melting system fine-mesh screen 27 may be fabricated and installed as an easily removable and/or replaceable part of the system, and preferably would be designed to slide in and out of compartmentalized pump tank assembly 20 via a slotted guide. The design should preferably allow removal and replacement of the screen within the compartmentalized pump tank assembly in "hot" condition, i.e., while molten sulfur at 245° F., or higher, flows through it.

Molten sulfur exiting melter 14 as melter overflow molten sulfur 18 and melter underflow molten sulfur 22 enters downstream collection compartment 21 and passes through fine-mesh screen 27 into pumping compartment 28. Pumping compartment 28 is provided with pumps and pumping equipment that pump molten sulfur from compartmentalized pump tank assembly 20 to the shell-and-tube heat exchangers and to a molten sulfur product tank or other suitable destination. Thus, heat exchanger sulfur pump 29, operated by heat exchanger sulfur pump motor 30, pumps molten sulfur 31 into the tube side inlet head 32 of shell-and-tube heat exchanger 33; while product storage tank sulfur pump 34, operated by product storage tank sulfur pump motor 35, pumps molten sulfur 36 into sulfur product storage tank 39. One or more strainers 37 are provided between compartmentalized pump tank assembly 20 and sulfur product storage tank 39 in order to remove certain entrained solid impurities that may still be present in the molten sulfur at this point in the system. Two duplex inline strainers are preferred for removing the entrained particulates. Clean molten sulfur product 38, at a rate of approximately 200 TPH, is then stored in sulfur product storage tank 39, from where it may be stored, pumped or otherwise delivered off battery limits to the customer's molten sulfur storage facilities. Sulfur product storage tank 39 is provided with steam blisters or other heating means (not shown) to aid in keeping it at an acceptable temperature. Depending on customer needs and the specific logistics of the operations, it may also be practicable to allow the sulfur in pumping compartment 28 to overflow pumping compartment 28 into another vessel or container rather than pumping it to sulfur product storage tank 39.

The bulk of the non-meltables that were caused to be deposited in collection compartment 21 can be removed from the bottom of compartmentalized pump tank assembly 20 in "hot" condition. When the volume of non-meltables builds up against weir 26 feed conveyor 7 is stopped and new bulk solid sulfur feed to the melting system is discontinued; a large hatch (not shown) on top of compartmentalized pump tank assembly 20 is then opened, allowing access to the interior of the assembly, where non-meltables 24 are subsequently easily removed by a few excavator scoops. Feed conveyor 7 is subsequently restarted and the melting process continued. This particular step (opening compartmentalized pump tank assembly 20 and scooping out accumulated non-meltables 24) only takes a couple of hours and is much faster and efficient than the steps taken in conventional melting methods, where tank cleanouts require drainage, cooling, clean out and reheating before resuming service, normally a five-to-seven day turnaround. Compartmentalized pump tank assembly 20 is provided with an automatic level control (not shown) such that all of the newly melted sulfur may be continually pumped to sulfur product storage tank 39 and, eventually, to customers' liquid storage facilities. Compartmentalized pump tank assembly 20 is also provided with steam blisters 40, or similar heating means, to aid in keeping it at an acceptable temperature (at least 245° F.).

As explained above, heat exchanger sulfur pump 29, operated by heat exchanger sulfur pump motor 30, pumps molten sulfur 31, at about 255° F., into the tube side inlet head 32 of shell-and-tube heat exchanger 33, where the molten sulfur is heated to between about 280° F. and 300° F. and circulated to high-capacity melting unit 13. More than one pump may be used to pump molten sulfur 31. The pump, or pumps, should provide sufficient pressure to pump the molten sulfur through the heat exchanger tubes and allow it to reach melter 14 after being heated to the desired temperature (between about 280° F. and 300° F.). In a preferred embodiment two shell-and-tube heat exchangers, connected in parallel, are used to perform the function of shell-and-tube heat exchanger 33. Steam 41 is injected into shell section 42 of shell-and-tube heat exchanger 33, where it give off heat before condensing and exiting shell-and-tube heat exchanger 33 as condensate 43. Maintaining steam pressure on the shell side of the exchanger at about 70 psig (316° F.) maximizes heat transfer without tube fouling. Flow rates through shell-and-tube heat exchanger 33 are designed to maintain satisfactory heat transfer coefficients and prevent tube fouling. In this fashion virtually the entire source of the heat supplied to high-capacity melting unit 13 for melting sulfur is provided by high-efficiency shell-and-tube heat exchanger 33. The thus heated molten sulfur exits heat exchanger 33 as hot liquid sulfur 44, at between about 280° F. and 300° F., and is then circulated to melter 14, where it transfers its heat to incoming bulk solid sulfur 11.

A molten sulfur product destination may be a sulfur product tank, similar to sulfur product storage tank 39, or it may be a sulfur processing system such as a sulfur filtration unit or any other system commonly employed to further process molten sulfur for a number of industrial uses, such as for feed to sulfuric acid manufacturing plants and the like. In order to achieve high efficiencies in the operation of the melting system and method the degree of turbulence provided inside the shell-and-tube heat exchangers should be enough to cause good heat transfer, but not so much as to cause erosion (excessive wear) of the tubes; also the amount, temperature and pressure of the steam used and the flow rates of the molten sulfur streams should be monitored and controlled in order to maintain the prescribed temperature ranges in the melter and in the shell-and-tube heat exchangers.

Figure 2:
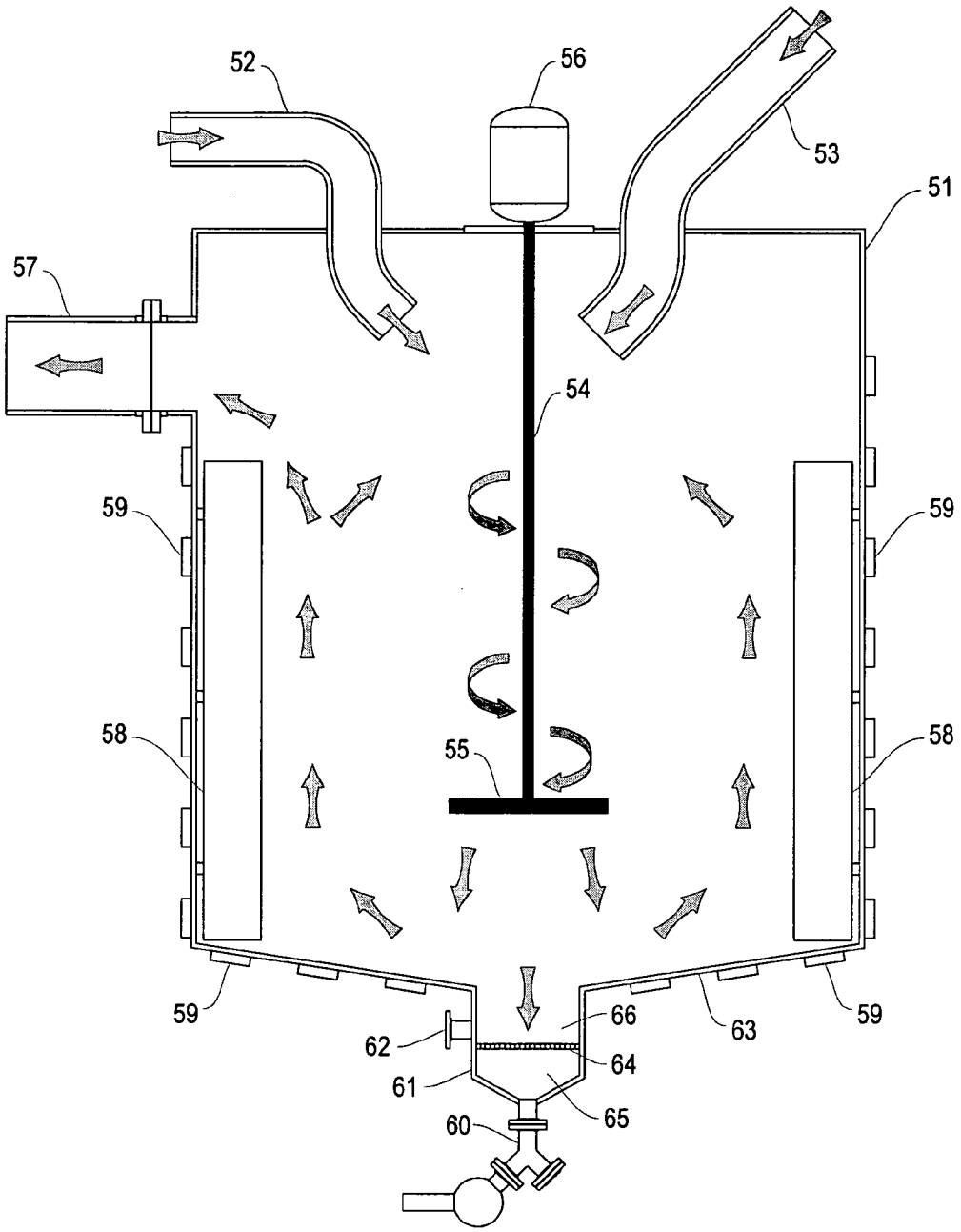
FIG. 2 is a schematic diagram depicting the key features of the melter component (high-capacity melting unit) of a preferred embodiment of the system of the invention.

A preferred embodiment of the high-capacity melting unit of the invention is shown in FIG. 2, where melter 51, equipped to receive solid sulfur through sulfur feed inlet pipe conduit 52 and molten sulfur through molten sulfur inlet pipe conduit 53, is depicted with one single agitator 54, having a single blade 55 and driven by agitator motor 56. Melter 51 is also provided with sulfur overflow pipe conduit 57, baffles 58 and steam blisters 59. The steam blisters are welded to the outer surface of melter 51, including the outer surface of its conical sloped bottom 63. Agitator 54 is used to provide vigorous agitation of the mixture of solid sulfur coming into the melter through sulfur feed inlet pipe conduit 52 and hot molten sulfur coming in through molten sulfur inlet pipe conduit 53. The vigorous agitation of the mixture immediately pulls the incoming solid sulfur beneath the surface of the liquid sulfur, wetting its solid surface and also quickly incorporating into the mixture the incoming hot molten sulfur, thereby causing the rapid melting of the incoming solid sulfur. Baffles 58 prevent the mixture from just spinning inside the melter; and the impact of the moving molten sulfur hitting the baffles causes additional turbulence and mixing within the melting unit. Baffles 58 also cause the molten sulfur to sweep across melter conical bottom 63, thereby reducing the potential for settling and buildup of non-meltables on the bottom. A first portion of the molten sulfur exits melter 51 through sulfur overflow pipe conduit 57 and is directed to the compartmentalized pump tank assembly of the system. A second portion of the molten sulfur passes through trash sump 61, exits the melter through sulfur underflow pipe conduit 60 and is also directed to the compartmentalized pump tank assembly of the system. Non-meltable solids that are too large to pass through sulfur underflow pipe conduit 60 are collected in the upper portion 66 of trash sump 61 from where they may be periodically removed through trash sump access man way 62. Removal of these larger solid non-meltables may be conveniently done by opening the blind closing flange of access man way 62 and disposing of them in appropriate fashion. Non-meltables include pebbles, rocks, nuts, bolts, bottles, wrenches, bricks, pieces of wood, debris, plastic bags, plastic containers and the like. Grating screen 64 separates upper portion 66 of trash sump 61 from the lower portion 65 of the sump. Non-meltables generally gravitate towards conical slopped bottom 63 of melter 51 and find their way into trash sump 61. Sulfur in trash sump 61 is generally outside of the vigorous agitation that takes place in melter 51 which allows both the larger and the smaller non-meltables to accumulate there. As previously mentioned, the larger non-meltables accumulate on the upper side of grating screen 64 in the upper portion 66 of trash sump 61, while the smaller non-meltables travel through grating screen 64 and into lower portion 65 of trash sump 61. The smaller non-meltables then travel with the aforementioned second portion of the molten sulfur which is passing through trash sump 61 and, together, they exit melter 51 through sulfur underflow pipe conduit 60, and are further directed to the compartmentalized pump tank assembly of the system, as shown on FIG. 1, where they are made to settle out and from where they are periodically removed by an excavator bucket or similar means.

Figure 3:
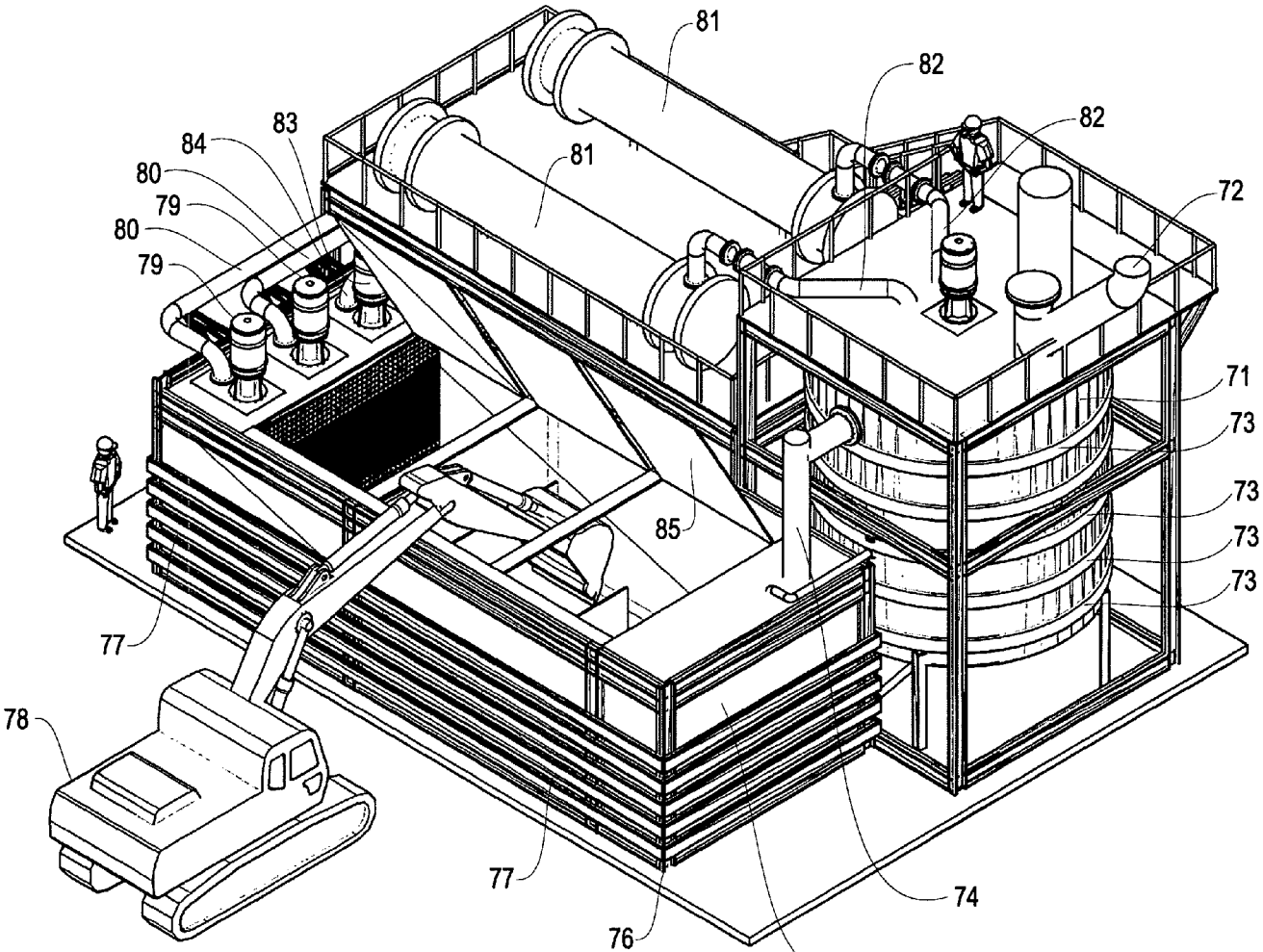
FIG. 3 is a rendering of a modular sulfur melting system designed after one of the preferred embodiments of the invention and showing the key modular components of the system of the invention and the key unit operations of the method of the invention.

FIG. 3 depicts the sulfur melting system of the invention in modular form, showing the key shop-fabricated modular components of the system and the key unit operations of the method of the invention. Referring to FIG. 3, melter 71 is equipped with solid sulfur inlet 72, adapted to receive solid sulfur from a conveyor discharge chute of a solid sulfur feed unit (not shown). Melter 71 is also equipped with steam blisters 73, spaced around its outer surface, and with sulfur overflow pipe conduit 74. Molten sulfur from melter 71 is made to flow through sulfur overflow pipe conduit 74 into collection compartment 75 of compartmentalized pump tank assembly 76, which is equipped with steam blisters 77 to aid in providing sufficient heat to keep the molten sulfur that flows through the assembly at the desired temperature of at least 245° F., as already explained. An excavator 78 is shown scooping out non-meltables from the bottom of compartmentalized pump tank assembly 76. Hatch 85, on top of compartmentalized pump tank assembly 76, provides access to the interior of the assembly, where the non-meltables are easily removed by a few excavator scoops. Heat exchanger pump motors 79 operate the heat exchanger pumps that pump molten sulfur out of compartmentalized pump tank assembly 76 through sulfur pipe conduits 80 into shell-and-tube heat exchangers 81, arranged in parallel fashion. Product sulfur pump motor 83 operates the product sulfur transfer pump that pumps molten sulfur out of compartmentalized pump tank assembly 76 through sulfur pipe conduit 84 into a sulfur product storage tank (not shown). The heated molten sulfur exits the tubes of shell-and-tube heat exchangers 81 through sulfur pipe conduits 82 and flows into the upper portion of melter 71, where it releases the bulk of the heat added in the heat exchangers, thereby melting the incoming solid sulfur fed to the melter through solid sulfur inlet 72 and maintaining it in molten state, thus completing the unit operation cycle.

Routine maintenance of the sulfur melting system by the operators may consist of general house-keeping, the switching and cleaning of operating strainers as their elements begin to clog and normal maintenance of lubricants, tightening valve packing, repair of minor steam/water drips, etc. Scheduled turnarounds may include pump, agitator and general conveyor servicing and routine motor control center maintenance, which can be done on a periodic basis. If convenient, the compartmentalized pump tank assembly may receive a complete cleanout during turnarounds.

While the present invention has been described herein in terms of particular embodiments and applications, in both summarized and detailed forms, it is not intended that any of these descriptions in any way should limit its scope to any such embodiments and applications; and it will be understood that substitutions, changes and variations in the described embodiments, applications and details of the method and the formulations disclosed herein can be made by those skilled in the art without departing from the spirit of this invention.

Where the article "a" (or "an") is used in the following claims, it is intended to mean "at least one" unless clearly indicated otherwise.

We claim:

1. A system for melting sulfur, said system comprising the following components in combination:

a) a high-capacity melting unit, equipped to receive solid sulfur from an outside source and melting it, and capable of processing between about 200 and 5,000 tons per day of sulfur, comprising a vessel (or "melter") having an inner surface, an outer surface and a sloped bottom, and provided with an agitator that is capable of imparting vigorous agitation to the solid sulfur received by said melter and with means for providing heat to said inner surface and said outer surface of the melter, said vigorous agitation causing rapid melting of the incoming solid sulfur and additional turbulence and mixing within the melter thus reducing the potential for contaminants settling within the melter, said means for providing heat to said inner surface and outer surface of the melter spaced around said outer surface of the melter;

b) a pump for pumping molten sulfur, operably connected to said high-capacity melting unit and capable of pumping molten sulfur to a shell-and-tube heat exchanger and to a molten sulfur product destination; and c) a shell-and-tube heat exchanger, located outside said high-capacity melting unit and operably connected to and adapted to receive molten sulfur pumped by said pump for pumping molten sulfur into its tubes, allow said molten sulfur to flow inside and through said heat exchanger tube and be heated to a temperature of between about 275° F. and about 350° F. in said heat exchanger tubes by steam flowing through its shell and return it to said high-capacity melting unit.

2. The system of claim 1, wherein said melter is made of steel, has a substantially round shape and at least two baffles that prevent said solid sulfur from just spinning inside the melter.

3. The system of claim 1, wherein said high-capacity melting unit is capable of processing at least 2,400 tons per day of sulfur, and wherein said means for providing heat to said inner surface and said outer surface of the melter are capable of providing sufficient heat to maintain the temperature of said inner surface and said outer surface of the melter at approximately 245° F. or higher.

4. The system of claim 1, wherein said means for providing heat to said inner surface and said outer surface of the melter are steam blisters.

5. The system of claim 1, wherein said molten sulfur product destination is a molten sulfur storage tank.

6. A system for melting sulfur, said system comprising the following components in combination:

a) a solid sulfur feed unit, said solid sulfur feed unit comprising (i) a bulk solid sulfur feed hopper, (ii) a melter feed conveyor that is connectable to and adapted to receive solid sulfur from the discharge end of said bulk solid sulfur feed hopper and (iii) a sulfur discharge chute that is connectable to and adapted to receive solid sulfur from the discharge end of said melter feed conveyor and that is connectable to and adapted to feed solid sulfur to the solid sulfur inlet of a high-capacity melting unit;

b) a high-capacity melting unit, capable of processing between about 200 and 5,000 tons per day of sulfur, operably connected to and adapted to receive solid sulfur from said solid sulfur feed unit and melting it, said high-capacity melting unit comprising a vessel (or "melter") having an inner surface, an outer surface and a sloped bottom, and provided with an agitator that is capable of imparting vigorous agitation to the solid sulfur received by said melter and with means for providing heat to said inner surface and said outer surface of the melter, said vigorous agitation causing rapid melting of the incoming solid sulfur and additional turbulence and mixing within the melter thus reducing the potential for contaminants settling within the melter, said means for providing heat to said inner surface and outer surface of the melter spaced around said outer surface of the melter;

c) a compartmentalized pump tank assembly, operably connected to and adapted to receive molten sulfur from said high-capacity melting unit, said compartmentalized pump tank assembly comprising (i) a collection compartment equipped to receive and hold molten sulfur from said high-capacity melting unit, (ii) a pumping compartment located downstream from said collection compartment and equipped with a pump for pumping molten sulfur to a shell-and-tube heat exchanger and to a molten sulfur product destination, (iii) a weir and a fine-mesh screen, said weir and fine-mesh screen located between said collection compartment and said pumping compartment, said fine-mesh screen located above said weir and capable of allowing large-size non-meltables (solids other than sulfur) to be collected in said collection compartment from where they may be conveniently removed periodically, and (iv) means for providing sufficient heat to said compartmentalized pump tank assembly to maintain the temperature of the molten sulfur inside the assembly at approximately 245° F. or higher; and d) a shell-and-tube heat exchanger, located outside said high-capacity melting unit and operably connected to and adapted to receive molten sulfur pumped from said compartmentalized pump tank assembly, allow said molten sulfur from said compartmentalized pump tank assembly to flow inside and through its heat exchanger tubes and be heated to a temperature of between about 275° F. and about 350° F., while steam is made to flow inside and through its heat exchanger shell, and return said heated molten sulfur to said high-capacity melting unit.

7. The system of claim 6, wherein said melter is made of steel, has a substantially round shape and at least two baffles that prevent said solid sulfur from just spinning inside the melter.

8. The system of claim 6, wherein said high-capacity melting unit is capable of processing at least 2,400 tons per day of sulfur, and wherein said means for providing heat to said inner surface and said outer surface of the melter are capable of providing sufficient heat to maintain the temperature of said inner surface and said outer surface of the melter at approximately 245° F. or higher.

9. The system of claim 6, wherein said means for providing heat to said inner surface and said outer surface of the melter are steam blisters.

10. The system of claim 6, wherein said solid sulfur received by said high-capacity melting unit is selected from the group consisting of crushed vat sulfur, crushed lumps of sulfur, formed slate sulfur, formed sulfur prills, formed sulfur pellets, formed sulfur pastilles, formed sulfur flakes and formed sulfur granules.

11. The system of claim 6, wherein said molten sulfur product destination is a molten sulfur storage tank.

12. The system of claim 6, wherein said collection compartment within said compartmentalized pump tank assembly is subdivided into multiple sections by means of one or more baffles that provide a circuitous route for the molten sulfur flowing within said compartmentalized pump tank assembly.

13. The system of claim 6, wherein said fine-mesh screen within said compartmentalized pump tank assembly is made of steel and has mesh openings ranging in size between about 1/16 inch and about 1/2 inch.

14. A system for melting sulfur, said system comprising the following components in combination:

a) a solid sulfur feed unit, said solid sulfur feed unit comprising (i) a bulk solid sulfur feed hopper, (ii) a melter feed conveyor that is connectable to and adapted to receive solid sulfur from the discharge end of said bulk solid sulfur feed hopper and (iii) a sulfur discharge chute that is connectable to and adapted to receive solid sulfur from the discharge end of said melter feed conveyor and that is connectable to and adapted to feed solid sulfur to the solid sulfur inlet of a high-capacity melting unit;

b) a high-capacity melting unit, capable of processing between about 200 and 5,000 tons per day of sulfur, operably connected to and adapted to receive solid sulfur from said solid sulfur feed unit and melting it, said high-capacity melting unit comprising a vessel (or "melter") having an inner surface, an outer surface, an overflow pipe conduit, a trash collection sump and a conical sloped bottom, and provided with an agitator that is capable of imparting vigorous agitation to the solid sulfur received by said melter and with steam blisters, said vigorous agitation causing rapid melting of the incoming solid sulfur and additional turbulence and mixing within the melter thus reducing the potential for contaminants settling within the melter, said steam blisters spaced around said outer surface of said melter and capable of providing sufficient heat to maintain the temperature of said inner surface and said outer surface of the melter at approximately 245° F. or higher;

c) a compartmentalized pump tank assembly, operably connected to and adapted to receive molten sulfur from said high-capacity melting unit, said compartmentalized pump tank assembly comprising (i) a collection compartment equipped to receive and hold molten sulfur from said high-capacity melting unit and subdivided into multiple sections by means of one or more baffles that provide a circuitous route for the molten sulfur flowing within said compartmentalized pump tank assembly, (ii) a pumping compartment located downstream from said collection compartment and equipped with a pump for pumping molten sulfur to a shell-and-tube heat exchanger and to a molten sulfur product tank, (iii) a weir and a steel fine-mesh screen, said weir and steel fine-mesh screen located between said collection compartment and said pumping compartment, said steel fine-mesh screen located above said weir and having mesh openings ranging in size between about 1/16 inch and about 1/2 inch and capable of allowing non-meltables (solids other than sulfur) to be collected in said collection compartment from where they may be conveniently removed periodically, and (iv) steam blisters, spaced around said compartmentalized pump tank assembly, capable of providing sufficient heat to said compartmentalized pump tank assembly to maintain the temperature of the molten sulfur inside the assembly at approximately 245° F. or higher; and d) a shell-and-tube heat exchanger, located outside said high-capacity melting unit and operably connected to and adapted to receive molten sulfur pumped from said compartmentalized pump tank assembly, allow said molten sulfur from said compartmentalized pump tank assembly to flow inside and through its heat exchanger tubes and be heated to a temperature of between about 275° F. and about 350° F., while steam is made to flow inside and through its heat exchanger shell, and return said heated molten sulfur to said high-capacity melting unit.

15. A method for melting sulfur, said method comprising the following steps in combination:

a) receiving and melting solid sulfur in a high-capacity melting unit, said high-capacity melting unit equipped to receive solid sulfur from an outside source and melting it, and capable of processing between about 200 and 5,000 tons per day of sulfur, and comprising a vessel (or "melter") having an inner surface, an outer surface and a sloped bottom, said melter provided with an agitator that is capable of imparting vigorous agitation to the solid sulfur received by said melter, and with means for providing heat to said inner surface and said outer surface, said vigorous agitation causing rapid melting of the incoming solid sulfur and additional turbulence and mixing within the melter thus reducing the potential for contaminants settling within the melter, said means for providing heat to said inner surface and said outer surface spaced around said outer surface of the melter;

b) pumping the molten sulfur from the high-capacity melting unit to a shell-and-tube heat exchanger located outside the high-capacity melting unit and to a molten sulfur product destination; and c) allowing said molten sulfur pumped to said shell-and-tube heat exchanger to flow inside and through said heat exchanger tubes while heating it to a temperature of between about 275° F. and about 350° in said heat exchanger tubes by steam flowing through its shell and returning the heated molten sulfur to the high-capacity melting unit.

16. The method of claim 15, wherein said melter is made of steel, has a substantially round shape and at least two baffles that prevent said solid sulfur from just spinning inside the melter.

17. The method of claim 15, wherein said high-capacity melting unit is capable of processing at least 2,400 tons per day of sulfur, and wherein said means for providing heat to said inner surface and said outer surface of the melter are capable of providing sufficient heat to maintain the temperature of said inner surface and said outer surface of the melter at approximately 245° F. or higher.

18. The method of claim 15, wherein said means for providing heat to said inner surface and said outer surface of the melter are steam blisters.

19. The method of claim 15, wherein said molten sulfur product destination is a molten sulfur storage tank.

20. A method for melting sulfur, said method comprising the following steps in combination:

a) feeding solid sulfur to a high-capacity melting unit through a solid sulfur feed unit, said solid sulfur feed unit comprising (i) a bulk solid sulfur feed hopper, (ii) a melter feed conveyor that is connectable to and adapted to receive solid sulfur from the discharge end of said bulk solid sulfur feed hopper and (iii) a sulfur discharge chute that is connectable to and adapted to receive solid sulfur from the discharge end of said melter feed conveyor and that is connectable to and adapted to feed solid sulfur to the solid sulfur inlet of said high-capacity melting unit;

b) melting said solid sulfur feed in said high-capacity melting unit, said high-capacity melting unit capable of processing between about 200 and 5,000 tons per day of sulfur and equipped to receive solid sulfur from said solid sulfur feed unit and melting it, and comprising a vessel (or "melter") having an inner surface, an outer surface and a sloped bottom, said melter provided with an agitator that is capable of imparting vigorous agitation to the solid sulfur received by said melter, and with means for providing heat to said inner surface and said outer surface, said vigorous agitation causing rapid melting of the incoming solid sulfur and additional turbulence and mixing within the melter thus reducing the potential for contaminants settling within the melter, said means for providing heat to said inner surface and said outer surface spaced around said outer surface of the melter;

c) transferring the molten sulfur from the high-capacity melting unit to a compartmentalized pump tank assembly, adapted to receive and hold molten sulfur from said high-capacity melting unit, said compartmentalized pump tank assembly comprising (i) a collection compartment equipped to receive and hold molten sulfur from said high-capacity melting unit, (ii) a pumping compartment located downstream from said collection compartment and equipped with means a ump for pumping molten sulfur to a shell-and-tube heat exchanger and to a molten sulfur product destination, (iii) a weir and a fine-mesh screen, said weir and fine-mesh screen located between said collection compartment and said pumping compartment, said fine-mesh screen located above said weir and capable of allowing large-size non-meltables (solids other than sulfur) to be collected in said collection compartment from where they may be conveniently removed periodically, and (iv) means for providing sufficient heat to said compartmentalized pump tank assembly to maintain the temperature of the molten sulfur inside the assembly at approximately 245° F. or higher;

d) pumping at least a portion of said molten sulfur received and held in said compartmentalized pump tank assembly to a shell-and-tube heat exchanger, located outside said high-capacity melting unit and operably adapted to receive molten sulfur pumped from said compartmentalized pump tank assembly, allowing said portion of molten sulfur from said compartmentalized pump tank assembly to flow inside and through the tubes of said shell-and-tube heat exchanger while heating it to a temperature of between about 275° F. and about 350° F. by means of steam flowing inside and through the shell of said shell-and-tube heat exchanger, and returning the heated molten sulfur to said high-capacity melting unit; and e) pumping at least a portion of said molten sulfur received and held in said compartmentalized pump tank assembly to said molten sulfur product destination.

21. The method of claim 20, wherein said melter is made of steel, has a substantially round shape and at least two baffles that prevent said solid sulfur from just spinning inside the melter.

22. The method of claim 20, wherein said high-capacity melting unit is capable of processing at least 2,400 tons per day of sulfur, and wherein said means for providing heat to said inner surface and said outer surface of the melter are capable of providing sufficient heat to maintain the temperature of said inner surface and said outer surface of the melter at approximately 245° F. or higher.

23. The method of claim 20, wherein said means for providing heat to said inner surface and said outer surface of the melter are steam blisters.

24. The method of claim 20, wherein said solid sulfur fed to said high-capacity melting unit is selected from the group consisting of crushed vat sulfur, crushed lumps of sulfur, formed slate sulfur, formed sulfur prills, formed sulfur pellets, formed sulfur pastilles, formed sulfur flakes and formed sulfur granules.

25. The method of claim 20, wherein said molten sulfur product destination is a molten sulfur storage tank.

26. The method of claim 20, wherein said collection compartment within said compartmentalized pump tank assembly is subdivided into multiple sections by means of one or more baffles that provide a circuitous route for the molten sulfur flowing within said compartmentalized pump tank assembly.

27. The method of claim 20, wherein said fine-mesh screen within said compartmentalized pump tank assembly is made of steel and has mesh openings ranging in size between about 1/16 inch and about 1/2 inch.

28. A method for melting sulfur, said method comprising the following steps in combination:

a) feeding solid sulfur to a high-capacity melting unit through a solid sulfur feed unit, said solid sulfur feed unit comprising (i) a bulk solid sulfur feed hopper that is provided with a vibrator and a lump breaker crusher, (II) a melter feed conveyor that is connectable to and adapted to receive solid sulfur from the discharge end of said bulk solid sulfur feed hopper and (iii) a sulfur discharge chute that is connectable to and adapted to receive solid sulfur from the discharge end of said melter feed conveyor and that is connectable to and adapted to feed solid sulfur to the solid sulfur inlet of said high-capacity melting unit;

b) melting said solid sulfur feed in said high-capacity melting unit, said high-capacity melting unit capable of processing between about 200 and 5,000 tons per day of sulfur and equipped to receive solid sulfur from said solid sulfur feed unit and melting it, and comprising a vessel (or "melter") having an inner surface, an outer surface, an overflow pipe conduit, a trash collection sump and a conical sloped bottom, and provided with an agitator that is capable of imparting vigorous agitation to the solid sulfur received by said melter and with steam blisters, said vigorous agitation causing rapid melting of the incoming solid sulfur and additional turbulence and mixing within the melter thus reducing the potential for contaminants settling within the melter, said steam blisters spaced around said outer surface of said melter and capable of providing sufficient heat to maintain the temperature of said inner surface and said outer surface of the melter at approximately 245° F. or higher;

c) transferring the molten sulfur from the high-capacity melting unit to a compartmentalized pump tank assembly, adapted to receive and hold molten sulfur from said high-capacity melting unit, said compartmentalized pump tank assembly comprising (i) a collection compartment equipped to receive and hold molten sulfur from said high-capacity melting unit and subdivided into multiple sections by means of one or more baffles that provide a circuitous route for the molten sulfur flowing within said compartmentalized pump tank assembly, (ii) a pumping compartment located downstream from said collection compartment and equipped with means a pump for pumping molten sulfur to a shell-and-tube heat exchanger and to a molten sulfur product tank, (iii) a weir and a steel fine-mesh screen, said weir and steel fine-mesh screen located between said collection compartment and said pumping compartment, said steel fine-mesh screen located above said weir and having mesh openings ranging in size between about 1/16 inch and about 1/2 inch and capable of allowing non-meltables (solids other than sulfur) to be collected in said collection compartment from where they may be conveniently removed periodically, and (iv) steam blisters, spaced around said compartmentalized pump tank assembly, capable of providing sufficient heat to said compartmentalized pump tank assembly to maintain the temperature of the molten sulfur inside the assembly at approximately 245° F. or higher;

d) pumping at least a portion of said molten sulfur received and held in said compartmentalized pump tank assembly to a shell-and-tube heat exchanger, located outside said high-capacity melting unit and operably adapted to receive molten sulfur pumped from said compartmentalized pump tank assembly, allowing said portion of molten sulfur from said compartmentalized pump tank assembly to flow inside and through the tubes of said shell-and-tube heat exchanger while heating it to a temperature of between about 275° F. and about 350° F. by means of steam flowing inside and through the shell of said shell-and-tube heat exchanger, and returning the heated molten sulfur to said high-capacity melting unit; and e) pumping at least a portion of said molten sulfur received and held in said compartmentalized pump tank assembly to said molten sulfur product tank.

* * * * *